US010400959B2

(12) United States Patent
Kuenzler

(10) Patent No.: US 10,400,959 B2
(45) Date of Patent: Sep. 3, 2019

(54) LED LAMP

(75) Inventor: Glenn Howard Kuenzler, Beachwood, OH (US)

(73) Assignee: LUMINATION LLC, Cleveland, OH (US)

( * ) Notice: Subject to any disclaimer, the term of this patent is extended or adjusted under 35 U.S.C. 154(b) by 693 days.

(21) Appl. No.: 12/942,053

(22) Filed: Nov. 9, 2010

(65) Prior Publication Data

US 2012/0112615 A1 May 10, 2012

(51) Int. Cl.

| | |
|---|---|
| ***F21V 29/77*** | (2015.01) |
| ***F21K 9/232*** | (2016.01) |
| *F21V 23/00* | (2015.01) |
| *F21V 29/83* | (2015.01) |
| *F21Y 115/10* | (2016.01) |
| *F21K 9/238* | (2016.01) |

(52) U.S. Cl.

CPC ..... *F21K 9/232* (2016.08); *F21V 29/777* (2015.01); *F21K 9/238* (2016.08); *F21V 23/006* (2013.01); *F21V 29/83* (2015.01); *F21Y 2115/10* (2016.08)

(58) Field of Classification Search

CPC ..... F21K 9/232; F21K 9/238; F21V 29/777; F21V 29/83; F21V 23/006; F21Y 2115/10

USPC ..... 362/480, 546, 547, 218, 294, 373, 555, 362/235, 249.01, 249.02; 313/17, 20, 33, 313/46, 45; 439/487; 257/81

See application file for complete search history.

(56) References Cited

U.S. PATENT DOCUMENTS 7,434,964 B1 * 10/2008 Zheng et al. ..... 362/294
7,781,787 B2 * 8/2010 Suehiro et al. ..... 257/98
8,534,880 B1 * 9/2013 Berg ..... F21V 29/505 362/218
2004/0114367 A1 * 6/2004 Li ..... F21K 9/232 362/248
2005/0073244 A1 * 4/2005 Chou et al. ..... 313/498
2005/0111229 A1 * 5/2005 Shemitz et al. ..... 362/373
2006/0109661 A1 * 5/2006 Coushaine ..... F21K 9/00 362/373
2007/0159828 A1 * 7/2007 Wang ..... 362/294
2008/0291663 A1 * 11/2008 Wedell ..... F21K 9/00 362/147
2009/0040776 A1 * 2/2009 Zhang et al. ..... 362/373
2009/0065792 A1 * 3/2009 Thompson et al. ..... 257/98
2009/0080205 A1 3/2009 Chang (Continued)

FOREIGN PATENT DOCUMENTS

CN 1836339 A 9/2006
CN 101260980 A 9/2008

(Continued)

OTHER PUBLICATIONS

PCT Search Report from PCT/US2011/055185.

*Primary Examiner* — Anh T Mai
*Assistant Examiner* — Fatima N Farokhrooz
(74) *Attorney, Agent, or Firm* — Fay Sharpe LLP

(57) ABSTRACT

A lamp having a substantially hollow columnar body. A plurality of light emitting diodes are disposed on the columnar body. A plurality of fins are also disposed on the columnar body. A base member is included at a first end of the columnar body and provides a means for electrical connection. An electronics module is included within the columnar body communication with the base member for converting AC current to DC current.

16 Claims, 2 Drawing Sheets

(56) References Cited

U.S. PATENT DOCUMENTS

| | | | | |
|---|---|---|---|---|
| 2009/0168417 | A1* | 7/2009 | Zhang | F21S 6/00 362/234 |
| 2009/0251882 | A1* | 10/2009 | Ratcliffe | 362/84 |
| 2010/0053963 | A1* | 3/2010 | Yang et al. | 362/249.02 |
| 2010/0073924 | A1* | 3/2010 | Deng | 362/231 |
| 2010/0148652 | A1* | 6/2010 | Vetrovec | 313/46 |
| 2011/0089830 | A1* | 4/2011 | Pickard et al. | 315/32 |
| 2011/0090699 | A1* | 4/2011 | Shida et al. | 362/294 |
| 2011/0140586 | A1* | 6/2011 | Wang | F21V 3/02 313/46 |
| 2011/0298350 | A1* | 12/2011 | van de Ven | 313/46 |
| 2011/0309735 | A1* | 12/2011 | Parker | F21V 3/02 313/46 |
| 2012/0048511 | A1* | 3/2012 | Moshtagh | F21K 9/135 165/80.2 |
| 2012/0087118 | A1* | 4/2012 | Bailey et al. | 362/235 |
| 2012/0188771 | A1* | 7/2012 | Kraus et al. | 362/294 |
| 2013/0235586 | A1* | 9/2013 | Gielen et al. | 362/294 |

FOREIGN PATENT DOCUMENTS

| | | |
|---|---|---|
| DE | 20 2010 006197 | 7/2010 |
| WO | WO 2010/024583 | 3/2010 |
| WO | WO 2010/058325 | 5/2010 |

* cited by examiner

LED LAMP

BACKGROUND

The following relates to the illumination arts, lighting arts, solid-state lighting arts, and related technical fields.

Incandescent and halogen lamps are conventionally used as both omni-directional and directional light sources. Omnidirectional lamps are intended to provide substantially uniform intensity distribution over a wide angle in the far field (greater than 1 meter away from the lamp) and find diverse applications such as in desk lamps, table lamps, decorative lamps, chandeliers, ceiling fixtures, and other applications where a uniform distribution of light in all directions is desired.

With reference to FIG. 1, a coordinate system is described which is used herein to describe the spatial distribution of illumination generated by an incandescent lamp or, more generally, by any lamp intended to produce omnidirectional illumination. The coordinate system is of the spherical coordinate system type, and is shown with reference to an incandescent A-19 style lamp L. For the purpose of describing the far field illumination distribution, the lamp L can be considered to be located at a point L0, which may for example coincide with the location of the incandescent filament. Adapting spherical coordinate notation conventionally employed in the geographic arts, a direction of illumination can be described by an elevation or latitude coordinate and an azimuth or longitude coordinate. However, in a deviation from the geographic arts convention, the elevation or latitude coordinate used herein employs a range [0°, 180°] where: $\theta=0°$ corresponds to "geographic north" or "N". This is convenient because it allows illumination along the direction $\theta=0°$ to correspond to forward-directed light. The north direction, that is, the direction $\theta=0°$, is also referred to herein as the optical axis. Using this notation, $\theta=180°$ corresponds to "geographic south" or "S" or, in the illumination context, to backward-directed light. The elevation or latitude $\theta=90°$ corresponds to the "geographic equator" or, in the illumination context, to sideways-directed light.

With continuing reference to FIG. 1, for any given elevation or latitude an azimuth or longitude coordinate $\phi$ can also be defined, which is everywhere orthogonal to the elevation or latitude $\theta$. The azimuth or longitude coordinate $\theta$ has a range [0°, 360°], in accordance with geographic notation.

It will be appreciated that at precisely north or south, that is, at $\theta=0°$ or at $\theta=180°$ (in other words, along the optical axis), the azimuth or longitude coordinate has no meaning, or, perhaps more precisely, can be considered degenerate. Another "special" coordinate is $\theta=90°$ which defines the plane transverse to the optical axis which contains the light source (or, more precisely, contains the nominal position of the light source for far field calculations, for example the point L0).

In practice, achieving uniform light intensity across the entire longitudinal span $\phi=[0°, 360°]$ is typically not difficult, because it is straightforward to construct a light source with rotational symmetry about the optical axis (that is, about the axis $\theta=0°$). For example, the incandescent lamp L suitably employs an incandescent filament located at coordinate center L0 which can be designed to emit substantially omnidirectional light, thus providing a uniform intensity distribution respective to the azimuth $\theta$ for any latitude.

However, achieving ideal omnidirectional intensity respective to the elevational or latitude coordinate is generally not practical. For example, the lamp L is constructed to fit into a standard "Edison base" lamp fixture, and toward this end the incandescent lamp L includes a threaded Edison base EB, which may for example be an E25, E26, or E27 lamp base where the numeral denotes the outer diameter of the screw turns on the base EB, in millimeters. The Edison base EB (or, more generally, any power input system located "behind" the light source) lies on the optical axis "behind" the light source position L0, and hence blocks backward emitted light (that is, blocks illumination along the south latitude, that is, along $\theta=180°$, and so the incandescent lamp L cannot provide ideal omnidirectional light respective to the latitude coordinate. Commercial incandescent lamps, such as 60 W Soft White incandescent lamps (General Electric, New York, USA) are readily constructed which provide intensity across the latitude span $\theta=[0°, 135°]$ which is uniform to within ±20% of the average intensity over that latitude range.

By comparison with incandescent and halogen lamps, solid-state lighting technologies such as light emitting diode (LED) devices are highly directional by nature, as they are a flat device emitting from only one side. For example, an LED device, with or without encapsulation, typically emits in a directional Lambertian spatial intensity distribution having intensity that varies with $\cos(\theta)$ in the range $\theta=[0°, 90°]$ and has zero intensity for $\theta>90°$. A semiconductor laser is even more directional by nature, and indeed emits a distribution describable as essentially a beam of forward-directed light limited to a narrow cone around $\theta=0°$. Accordingly, providing solid-state lighting with an appearance resembling typical incandescent lamps is challenging.

Another challenge associated with solid-state lighting is that unlike an incandescent filament, an LED chip or other solid-state lighting device typically cannot be operated efficiently using standard 110V or 220V a.c. power. Rather, on-board electronics are typically provided to convert the a.c. input power to d.c. power of lower voltage amenable for driving the LED chips. As an alternative, a series string of LED chips of sufficient number can be directly operated at 110V or 220V, and parallel arrangements of such strings with suitable polarity control (e.g., Zener diodes) can be operated at 110V or 220V a.c. power, albeit at substantially reduced power efficiency. In either case, the electronics constitute additional components of the lamp base as compared with the simple Edison base used in integral incandescent or halogen lamps. Accordingly, a space absorbing electronic package is required for solid-state lighting, further complicating the skilled artisan's ability to extract omnidirectional illumination.

Yet another challenge in solid-state lighting is the need for heat sinking. LED devices are highly temperature-sensitive in both performance and reliability as compared with incandescent or halogen filaments. This is addressed by placing a mass of heat sinking material (that is, a heat sink) contacting or otherwise in good thermal contact with the LED device. The space occupied by the heat sink blocks emitted light and hence further limits the ability to generate an omnidirectional LED-based lamp. This limitation is enhanced when a LED lamp is constrained to the physical size of current regulatory limits (ANSI, NEMA, etc.) that define maximum dimensions for all lamp components, including light sources, electronics, optical elements, and thermal management. Again, heat sink requirements can complicate the goal of providing omnidirectional lighting.

In short, the combination of electronics and heat sinking results in a large base that blocks "backward" illumination, which has heretofore substantially limited the ability to generate omnidirectional illumination using an LED replacement lamp.

BRIEF SUMMARY

Various details of the present disclosure are hereinafter summarized to provide a basic understanding. This summary is not an extensive overview of the disclosure and is intended neither to identify certain elements of the disclosure, nor to delineate the scope thereof. Rather, the primary purpose of the summary is to present certain concepts of the disclosure in a simplified form prior to the more detailed description that is presented hereinafter.

According to one embodiment, a lamp comprised of an at least substantially hollow columnar body is described. A plurality of light emitting diodes are disposed on the columnar body. A plurality of fins are also disposed on the columnar body. A base member is included at a first end of the columnar body and provides a means for electrical communication. An electronics module resides within the columnar body in electrical communication with the base member for converting AC current to DC current.

According to a further embodiment, lamp having an elongated hollow polygonal body is provided. The body can be composed of a material having a thermal conductivity greater than 100 W/mK. A fin extends radially from each corner of the body. At least one light emitting diode is mounted to each side of the body. A screw or wedge base connector closes a first end of the body with a second end being open. An electronics module is disposed within the body in electrical communication with the connector and the light emitting diodes. The lamp has a general A19 outline.

According to another embodiment, a method of manufacturing a lamp is disclosed. The method includes extruding an elongated hollow body comprised of a material having a thermal conductivity greater than 100 W/mK. The extruded body is cut to a predetermined length and at least one light emitting diode is attached to the body. Electrical circuitry suitable for powering the light emitting diode is also provided. The material can have a thermal conductivity greater than about 170 W/mK. A plurality of integral radially extending fins can be co-extruded with the body.

BRIEF DESCRIPTION OF THE DRAWINGS

The invention may take form in various components and arrangements of components, and in various process operations and arrangements of process operations. The drawings are only for purposes of illustrating embodiments and are not to be construed as limiting the invention.

DETAILED DESCRIPTION OF PREFERRED EMBODIMENTS

Figure 1:
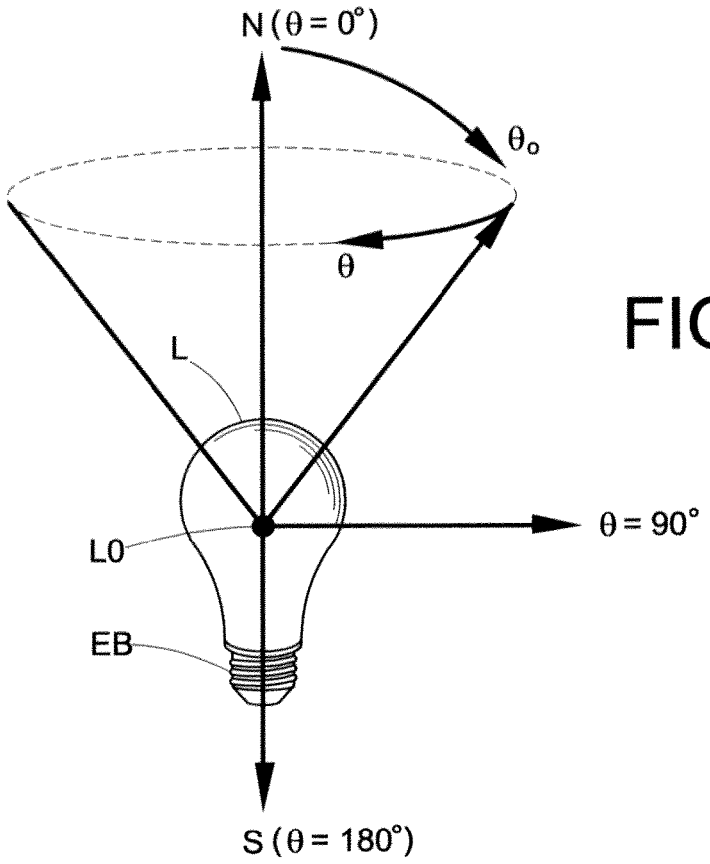
FIG. 1 diagrammatically shows, with reference to a conventional incandescent light bulb, a coordinate system that is used herein to describe illumination distributions.

One or more embodiments or implementations are hereinafter described in conjunction with the drawings, where like reference numerals are used to refer to like elements throughout, and where the various features are not necessarily drawn to scale.

The performance of an LED replacement lamp can be quantified by its useful lifetime, as determined by its lumen maintenance and its reliability over time. Whereas incandescent and halogen lamps typically have lifetimes in the range 1000 to 5000 hours, LED lamps are capable of >25,000 hours, and perhaps as much as 100,000 hours or more.

The temperature of the p-n junction in the semiconductor material from which the photons are generated is a significant factor in determining the lifetime of an LED lamp. Long lamp life is achieved at junction temperatures of about 100° C. or less, while severely shorter life occurs at about 150° C. or more, with a gradation of lifetime at intermediate temperatures. The power density dissipated in the semiconductor material of a typical high-brightness LED circa year 2009 (~1 Watt, ~50-100 lumens, ~1×1 mm square) is about 100 Watt/cm$^2$. By comparison, the power dissipated in the ceramic envelope of a ceramic metal-halide (CMH) arctube is typically about 20-40 W/cm$^2$. Whereas, the ceramic in a CMH lamp is operated at about 1200-1400 K at its hottest spot, the semiconductor material of the LED device should be operated at about 400 K or less, in spite of having more than 2× higher power density than the CMH lamp. The temperature differential between the hot spot in the lamp and the ambient into which the power must be dissipated is about 1000 K in the case of the CMH, but only about 100 K for the LED lamp. Accordingly, the thermal management must be on the order of ten times more effective for LED lamps than for typical HID lamps.

The presently disclosed lamp provides a system capable of sufficient heat dissipation to take advantage of the long life of a semiconductor life source operated at acceptable temperature levels and achieves a light distribution substantially equivalent to traditional incandescent lamps (e.g. θ-135°).

Figure 2:
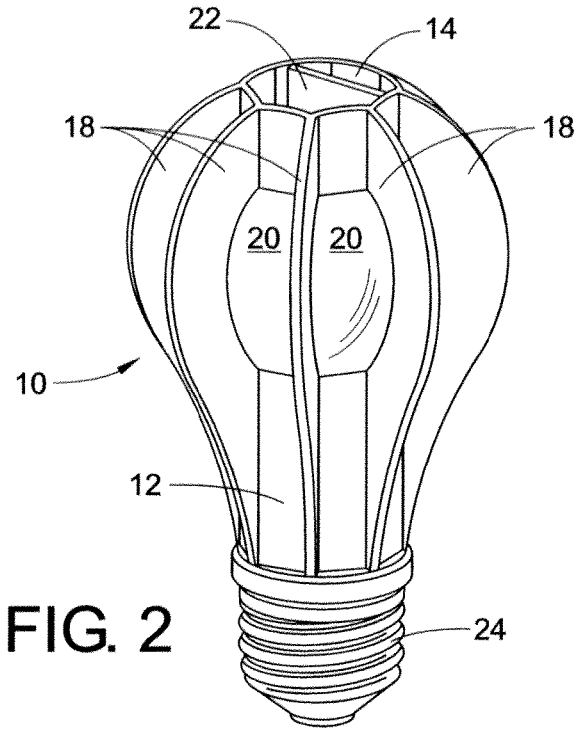
FIG. 2 is a perspective view of the present lamp.
Figure 3:
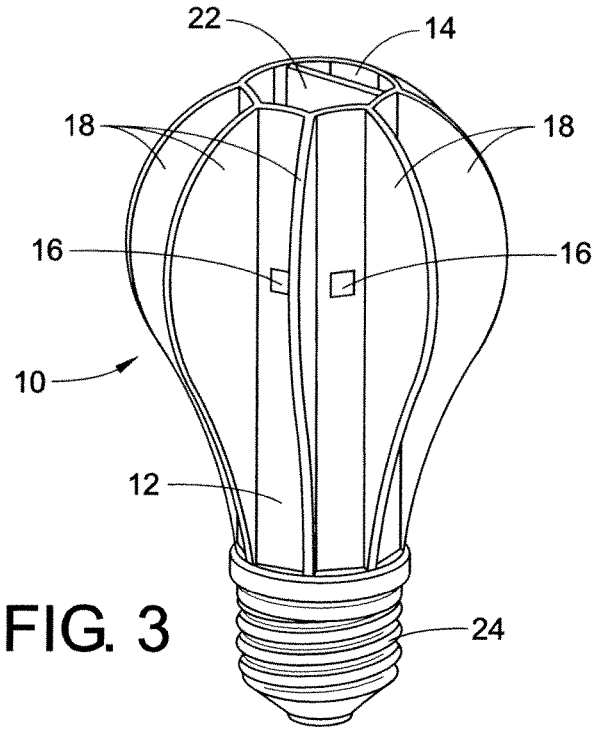
FIG. 3 is a perspective view of the lamp of FIG. 2 wherein the optics have been removed.

Referring now to FIGS. 2 and 3, one embodiment of an LED lamp is depicted. Lamp 10 includes an elongated columnar body 12. Columnar body 12 can be constructed of any thermally conductive material, such as metal or thermally conductive ceramic. The columnar body 12 is substantially hollow and includes an open top 14, which facilitates the natural convection of heat out of the lamp 10.

A plurality of light emitting diodes (LED's) 16 are disposed on the exterior surface of columnar body 12. The LED's can be any type used in semiconductor lighting emitting from red to ultraviolet wavelengths. Moreover, the LEDs can be selected such that the lamp generates a saturated color of light, blended (e.g. red, blue, green LEDs) to produce white light, or could generate white light via LED with a phosphor that is excited by the wavelength of light emitted by the LEDs.

A plurality of heat fins 18 are disposed on the exterior surface of columnar body 12. The heat from the LEDs is transmitted through columnar body 12 to the fins 18 and dissipated to keep the junction temperatures of the LEDs low enough to ensure long-life. The heat fins can have a thickness between, for example, 1.0 and 5.0 millimeters to provide the sufficient surface area and cross-sectional area for heat dissipation. A minimum thickness may be desired for specific fabrication techniques, such as machining, casting, injection molding, or other techniques known in the industry.

Advantageously, this design of a columnar body (heat sink) can be manufactured using an extrusion process followed by cutting to length, and to fin shape if the fins are extruded integrally with the columnar body. Most metal articles are presently made via die casting which can constrain the choice of materials to those with a maximum conductivity of less than 100 W/mK. Die casting also constrains geometric design options in view of draft requirements in various mold styles. Extrusion can allow the use of materials, aluminum alloys for example, having thermal conductivity of up to 170 W/mK and permits straight walled configurations. Accordingly, the columnar body can have substantially straight side walls and be constructed of a material having thermal conductivity in excess of 120 W/mK or excess of 150 W/mK.

The fin shape is preferably tapered around the light source, with its smallest width at 0° (above lamp) and 135° (below the lamp) as not to completely block emitted light. Providing enough surface area to dissipate the desired amount of heat from the LED light source is desirable. The number of heat fins will generally be determined by the required heat fin surface area needed to dissipate the heat generated by the LED light source and electronic components in the lamp. For example, a 60 W incandescent replacement LED lamp may consume roughly 10 W of power, approximately 80% of which must be dissipated by the heat sink to keep the LED and electronic components at a low enough temperature to ensure a long life product. As a general rule of thumb, a fin for each LED may be desirable. Of course, as LED efficiency improves and/or the thermal conductivity of the columnar body/fin materials improves, the number of fins can be reduced.

High reflectance (>70%) fin surfaces can be employed to improve light output. As there are often multiple bounces between LED light source, optical materials, phosphors, envelopes, and thermal heat sink materials in an LED lamp, the reflectivity has a multiplicative effect on the overall optical efficiency of the lamp. Specular fins may also be suitable in certain applications to smooth the peaks in the longitudinal intensity distribution.

Optics 20 are disposed between adjacent fins 18 and overlap the LED's 16. The optics can include phosphor and/or light scattering materials. In this regard, wedge-shaped optic covers can be placed over the LEDs for a number of possible purposes, such as to provide a more diffuse emission similar to standard incandescent technology, or to provide a remote phosphor that can be stimulated by a blue or violet LED light. Such covers, by being distant from the LEDs, can run cool, avoiding thermal and optical degration, while also providing a wider-angle light emission that provides good coverage in the up/down (axial) direction.

An electronics module 22 is contained within columnar body 12 in electrical communication with Edison screw base 24 (alternatively, a wedge base could be employed), to receive AC current and provide DC current to LED's 16. The electronics module can be electrically linked to the LEDs through wires, conductive tracing, or other mechanism known to the skilled artisan. In an alternative embodiment, the electronics module could reside within the electrical connector, the Edison screw base in this embodiment. The electronics module can be a printed circuit board with circuitry that converts AC to DC current.

Figure 4:
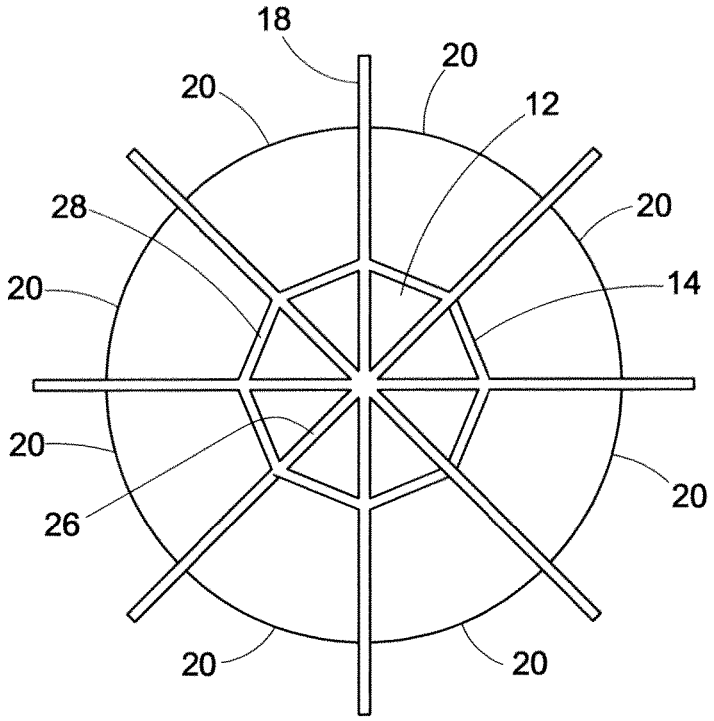
FIG. 4 is a top view of the an alternative of the present lamp.

Referring now to FIG. 4, a slight alternative embodiment is illustrated where fins 18 extend into an interior volume of hollow columnar body 12. More particularly, fins 18 include extended regions 26 mating at a center point 28. This construction may provide increased physical strength.

The LED's and fins can be substantially evenly spaced radially around the columnar body. The lamp columnar body can be in the form of a circle, trigon, tetragon, pentagon, hexagon, heptagon, octagon, nonagon, decagon, hendecagon, or dodecagon, as examples, in cross-section. The lamp can include at least one diode on each face of said columnar body between a cooperative pair of fins. In certain embodiments, a single LED resides on each face. In the case of the non-circular columnar bodies, one fin would be positioned on each corner of the columnar body. With LEDs mounted in between the fins, the heat can be conducted efficiently to the fins, which are arranged to provide a high degree of exposure to ambient (cool) air with minimal obstruction to the light.

In certain embodiments, the optic preferentially directs light perpendicular to an elongated axis of the columnar body. This is beneficial because from the top view, all LED's are emitting visible light, whereas at θ=at 90°, approximately only two columnar body sides are directly visible between the fins (for the depicted eight sided design). Accordingly, only two LED's contribute to the lamps brightness at this orientation. Preferential direction of light via the optics can improve the uniformity of light distribution for the lamp.

The present lamp advantageously 1) has a shape similar to the familiar A19 lamp, 2) provides a lot of open surface areas for cooling with minimal obstruction to the light, and 3) casts light in all directions without the shadowing problem prevalent in the industry today.

For most table lamps or decorative bathroom/chandelier lighting ambient temperature is considered to be 25° C., but ambient temperatures of 40° C. and above are possible, especially in enclosed luminaries or in ceiling use. Even with a rise in ambient, the junction temperature ($T_{junction}$) of an LED lamp should be kept below 100° C. for acceptable performance. For all LEDs there is a thermal resistance between the thermal pad temperature ($T_{pad}$) and the $T_{junction}$, usually on the order of 5° C.~15° C. Since ideally the $T_{junction}$ temperature is desired to be less than 100° C., the $T_{pad}$ temperature is desired to be less than 85° C.

Modifications, alterations, and combinations will occur to others upon reading and understanding the preceding detailed description. It is intended that the invention be construed as including all such modifications and alterations insofar as they come within the scope of the appended claims or the equivalents thereof.

What is claimed is:

1. A lamp comprised of an at least substantially hollow columnar body having a longitudinal axis, a plurality of light emitting diodes disposed on said columnar body, a plurality of fins including a first edge disposed on said columnar body and a second edge remote from the columnar body, said first edge oriented at least generally parallel to the longitudinal axis of the columnar body, opposed first end second side walls extending between the first edge and the second edge, said first and second side walls being disposed in at least substantially parallel planes, a light dispersing optic element overlapping and spaced from said diodes, said optic element including at least one of a phosphor and light scattering material, said optic element comprising a plurality of wedge-shaped optic elements, each element being disposed between a pair of adjacent fins and configured such that the exterior surfaces of the optic elements in combination form an at least substantially spherical body, a base member disposed at a first end of the columnar body and providing a means for electrical connection, and an electronics module disposed within the columnar body and in electrical communication with the base member.

2. The lamp of claim 1 wherein a second end of said columnar body is open.

3. The lamp of claim 1 wherein said diodes are substantially evenly spaced radially around the columnar body.

4. The lamp of claim 1 wherein said columnar body comprises one of a tetragon, pentagon, hexagon, heptagon, octagon, nonagon, decagon, hendecagon, or dodecagon in cross-section.

5. The lamp of claim 1 wherein said columnar body and said fins are comprised of a material having a thermal conductivity greater than 100 W/mK.

6. The lamp of claim 1 wherein said base member comprises an Edison screw base or a wedge base.

7. The lamp of claim 1 wherein said electronics module comprises a printed circuit board including circuitry for converting AC to DC current.

8. The lamp of claim 1 wherein said optic element preferentially directs light substantially perpendicular to an elongated axis of the columnar body.

9. The lamp of claim 1 wherein said second edge of said fins is free.

10. The lamp of claim 3 wherein said fins are substantially equally disposed between said diodes.

11. The lamp of claim 4 wherein at least one diode resides on each face of said columnar body.

12. The lamp of claim 11 wherein one fin resides on each corner of said columnar body.

13. The lamp of claim 12 wherein a single diode resides on each face and the number of diodes and fins is substantially equivalent.

14. The lamp of claim 12 including a single optic element disposed between and engaging each adjacent fin and overlapping said diode.

15. A lamp comprised of an at least substantially hollow columnar body having a longitudinal axis, a plurality of light emitting diodes disposed on said columnar body, a plurality of fins including a first edge disposed on said columnar body and a second edge remote from the columnar body, said first edge oriented at least generally parallel to the longitudinal axis of the columnar body, opposed first end second side walls extending between the first edge and the second edge, said first and second side walls being disposed in at least substantially parallel planes, a light dispersing optic element overlapping and spaced from said diodes, said optic element including at least one of a phosphor and light scattering material, a base member disposed at a first end of the columnar body and providing a means for electrical connection, and an electronics module disposed within the columnar body and in electrical communication with the base member, wherein the second edges of said fins in combination form an exterior portion of said lamp and provide a general A19 outline.

16. The lamp of claim 15 wherein said light dispersing optic element mates with each fin intermediate the first edge and the second edge.

* * * * *